US005797609A

United States Patent [19]

Fichepain

[11] Patent Number: 5,797,609

[45] Date of Patent: Aug. 25, 1998

[54] SHOE WITH RETRACTABLE ROLLERS

[75] Inventor: Frederic Fichepain, 16, rue de Flandro, F-75019 Paris, France

[73] Assignees: Claude Allouche; Daniel Amar; Frederic Fichepain, all of Paris, France; part interest to each

[21] Appl. No.: 676,329

[22] PCT Filed: Jan. 26, 1995

[86] PCT No.: PCT/FR95/00093

§ 371 Date: Jul. 22, 1996

§ 102(e) Date: Jul. 22, 1996

[87] PCT Pub. No.: WO95/20424

PCT Pub. Date: Aug. 3, 1995

[30] Foreign Application Priority Data

Jan. 26, 1994 [FR] France ..... 94 00859

[51] Int. Cl.[6] ..... A63C 17/20

[52] U.S. Cl. ..... 280/11.19; 280/11.27; 280/7.17; 36/115

[58] Field of Search ..... 280/7.1, 7.13, 280/7.17, 9, 841, 11.19, 11.77, 11.22; 36/115

[56] References Cited

U.S. PATENT DOCUMENTS

| | | | |
|---|---|---|---|
| 1,154,370 | 9/1915 | Burke | 280/9 |
| 2,095,942 | 10/1937 | Wetterstrand | 280/7.13 |
| 3,884,485 | 5/1975 | Walle | 280/841 |
| 3,979,842 | 9/1976 | Texidor | 280/11.19 |
| 3,983,643 | 10/1976 | Schreyer et al. | 36/115 |
| 5,398,970 | 3/1995 | Tucky | 280/11.19 |

*Primary Examiner*—Brian L. Johnson
*Assistant Examiner*—Min Yu
*Attorney, Agent, or Firm*—Young & Thompson

[57] ABSTRACT

Roller mounted shoe including at least one front roller (3*a*, 3*b*) and at least one rear roller (4*a*, 4*b*). The front (3*a*, 3*b*) and rear (4*a*, 4*b*) rollers are movable between a first ground-engaging position and a second raised position. The front (3*a*, 3*b*) and rear (4*a*, 4*b*) rollers are connected to one another by means of a flexible link (11) extending through the sole (2), so as to simultaneously displace the front (3*a*, 3*b*) and rear (4*a*, 4*b*) rollers using pull members connected to the flexible link (11).

12 Claims, 5 Drawing Sheets

SHOE WITH RETRACTABLE ROLLERS

BACKGROUND OF THE INVENTION

The present invention relates to a shoe with retractable rollers, as well as to a shoe sole comprising retractable rollers.

DESCRIPTION OF THE RELATED ART

The document GB-334 782 discloses a roller skate, in which the wheels are mounted on a hollow body in the form of a cradle. The hollow body in the form of a cradle is mounted oscillably by means of a rod connection between two end positions in one of which the wheels support the body in the form of a cradle whilst in the other end position, the body in the form of a cradle rests on the ground. This arrangement of roller skate requires the use of a complicated mechanical rod system and mechanical locking means which substantially raise the feet of the user into an uncomfortable position.

U.S. Pat. No. 3,884,485 relates to a retractable roller skate comprising a body adapted to be secured to a shoe, a plurality of rollers carried rotatably on retraction means and lodged in said body. The retraction means serve to displace said rollers into one of two distinct positions: in one position, the rollers are completely disposed within the body and, in the other separate position they extend at least partially beyond said body. The retraction means comprise pivoting levers lockable by means of a manual control button with spring return. Although this device is simpler than the device described in GB-334 782, it requires the use of mechanical means rendering impossible the integration of the roller skate platform to a shoe sole.

U.S. Pat. No. 3,979,842 discloses an exercise device comprising a shoe. This device comprises a thick sole in the interior of which levers urged by springs are mounted pivotally at one end whilst at their other end they bear a roller. Because the thick sole receives large mechanical forces transmitted by the pivots of the levers and also comprises the end abutment for the two positions of said levers, it is necessary to construct the thick sole of a relatively rigid material, such as a plastic material reinforced with glass fiber. The use of such a shoe with a rigid sole rapidly becomes uncomfortable and gives rise to excessive fatigue for the user.

U.S. Pat. No. 3,983,643 discloses a shoe usable for walking and roller skating.

This device is analogous to the preceding one in that it provides levers pivoting about fixed axles bearing the rollers disposed in a relatively thick and rigid shoe sole.

U.S. Pat. No. 4,333,249 discloses a device convertible for sport use. This device is a roller skate lockable between two positions by means of pivoting levers adapted to be locked between a retracted and a rolling position. This device is adapted to a shoe, but does not itself constitute a shoe adapted to the foot of a user.

The invention has for its object to provide a shoe comprising rollers retractable between two positions, not requiring the use of lever mechanisms of the prior art and permitting continuous use as roller skates and for walking in an ergonomic fashion not tiring to the user.

The invention has for its object a shoe with rollers, of the type comprising at least one front roller and at least one rear roller; the front and rear rollers being displaceable between a first position of contact with the ground and a second raised position, characterized in that the front and rear rollers are interconnected by at least one flexible link passing within the sole, so as to displace simultaneously the front and rear rollers with the aid of traction means connected to said flexible link.

SUMMARY OF THE INVENTION

According to other characteristics of the invention,

- the traction means comprise at least one flexible link, of which one end extending beyond the shoe comprises a gripping means of the handle or pull-knob type;
- said flexible link forming a part of said traction means passes through an internal recess of the sole;
- the traction means comprise locking means of the front and rear rollers in each of said two positions of contact with the ground and raised;
- the front and rear rollers are connected to front and rear plates adapted to slide along guide tracks secured to the sole;
- each front roller is mounted fixedly to a front axle, each rear roller is mounted fixedly to a rear axle, the axles are interconnected by at least one flexible link.

The invention also has for its object a shoe sole adapted to form or forming a body with a shoe of known type, provided with front and rear rollers displaceable between a position of contact with the ground and a raised position, characterized in that the sole comprises recesses adapted to lodge at least two flexible links, of which the first connects the front and rear rollers and of which at least a second is adapted to be pulled to displace the front and rear rollers from one of said two positions to the other of said two positions.

According to other characteristics of the invention:

- each said second flexible link adapted to be pulled opens to the outside of the sole and comprises at its outer end a blocking means of the hook, securement buckle, quick connection or "Velcro" (trademark) type, push button or the like;
- the sole comprises conformations constituting guide means for the displacement of the front and rear rollers;
- said conformations comprise a front slideway secured to the sole and a rear slideway secured to the sole.

BRIEF DESCRIPTION OF THE DRAWINGS

The invention will be better understood from the description which follows given by way of non-limiting example with reference to the accompanying drawings, in which.

DESCRIPTION OF THE PREFERRED EMBODIMENT

Figure 1:
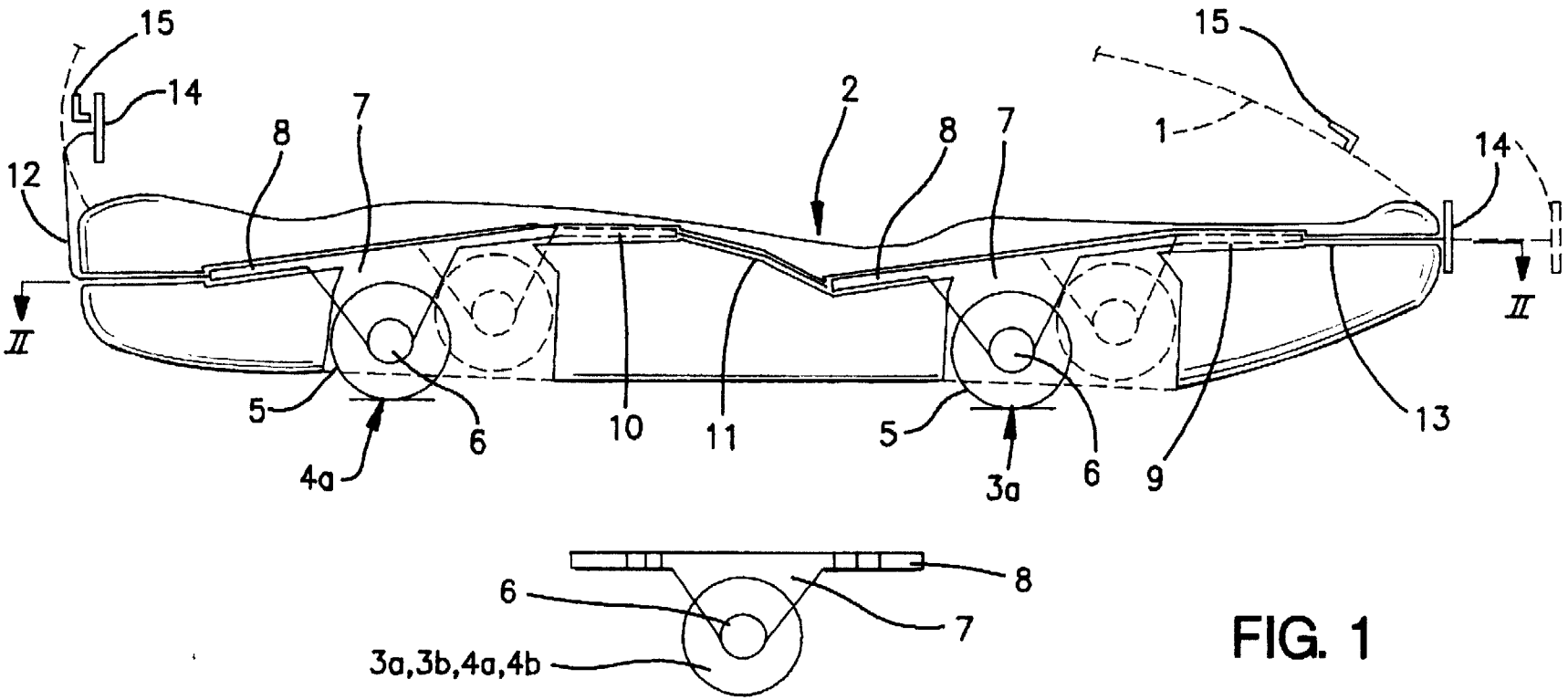
FIG. 1 shows schematically a cross-sectional view on the line I—I of FIG. 2 of a first embodiment of the invention.
Figure 2:
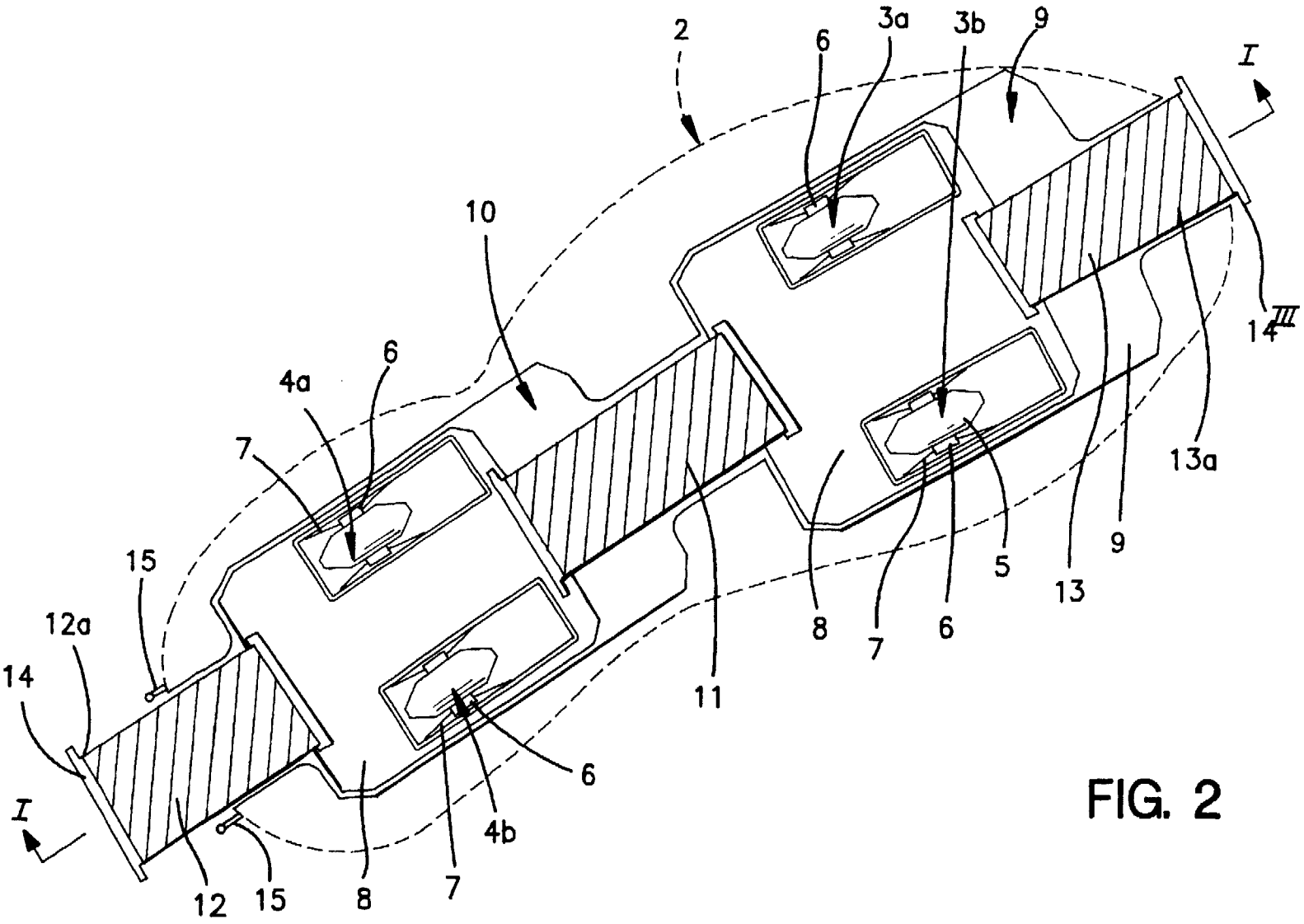
FIG. 2 shows schematically a cross-sectional view on the line II—II of FIG. 1 of a first embodiment of the invention.

Referring to FIGS. 1 and 2, a shoe with rollers according to the invention comprises an upper portion 1 shown in broken lines adapted to receive the foot of the user and a sole 2 adapted to the upper part 1, preferably secured to the latter. Two front rollers 3*a* and 3*b* and two rear rollers 4*a* and 4*b* are displaceable between a first position of contact with the ground represented in full lines and a second raised position represented in broken lines. The rolling surface 5 of the rollers 3*a*, 3*b*, 4*a*, 4*b* is preferably formed of non-skid material of the type of rubber, polyurethane or polyvinyl chloride (PVC).

Each roller 3*a*, 3*b*, 4*a*, 4*b* is freely rotatably mounted on an axle 6 secured to a support 7 itself secured to a plate 8 of flexible material. For the flexible material, can be mentioned plastic materials of the type of polyethylene, polypropylene, polyvinyl chloride or other resilient materials adapted to undergo a slight elastic deformation.

The sole 2 comprises in its thickness two recesses 9 and 10 shaped to the contour of the support plates 8 so as to constitute guide means for the plates 8 during displacement in translation under the action of traction means connected to said support plates 8.

According to the invention, the support plates 8 carrying front and rear rollers are connected to each other by a flexible link 11 passing within the sole 2, so as to displace simultaneously the front 3*a*, 3*b* and rear 4*a*, 4*b* rollers with the aid of traction means.

In this example, the traction means comprise two flexible links 12 and 13 having a projecting end 12*a* and 13*a* comprising gripping means 14.

As gripping means 14, can be cited a handle, a pull knob, a ring, a buckle, a hook or the like.

All the flexible links 11 through 13 pass within the sole 2 in a low corridor having a width suitable for the width of the flexible link.

As flexible link, can be cited straps, pulleys, reinforced fabric, chains, cables or strands.

Preferably, the flexible links 11 and 13 can be locked in position with the aid of blocking means coacting with the gripping means 14: to this end, the upper portion 1 of the shoe can comprise blocking members 15 of the type of hooks, disposed at a spacing greater than the width of a flexible link 12 and 13 and less than the width of a gripping means 14. Of course, the blocking means coacting with the gripping means can constitute the male portion of the coacting female portion, or vice versa; one could also use for blocking a button coacting with a hook, a securement loop coacting with a ring or a hook, a rapid connection of the "Velcro" (trademark) type, a push button or any other similar means preventing the rearward return of the flexible link 12 or 13.

The operation of the invention is as follows: after having detached the rear gripping means 14 from its blocking means 15 (FIG. 1) and after having pulled on the forward gripping means 14 in translation causing the assembly of the members secured to the front handle 14 to pass from the position shown in full lines to the position shown in broken lines, a displacement of all of the front and rear plates 8 is effected from the position shown in full lines to the position shown in broken lines. This movement of the plates 8 interconnected by the flexible link 11 gives rise to the passage of the front rollers 3*a*, 3*b* and rear rollers 4*a*, 4*b* from the first position in contact with the ground shown in full lines to the second raised position shown in broken lines.

The invention thus permits, in the position of contact with the ground shown in full lines, movement on rollers; whilst in the position shown in broken lines, the invention permits normal walking. A particular advantage of the invention resides in the fact that because of the small dimension of the passages for the flexible links 11, 12 and 13, the sole 2 is completely flexible and permits normal walking without fatigue. Preferably, the sliding recesses 9 and 10 are provided directly within the thickness of the sole or are clad at least partially in regions of friction with a material more resistant than the composition of the surface of the sole in contact with the ground.

So as to maintain good elasticity and good flexibility of the sole 2, the recesses 9 and 10 are slightly offset relative to each other in the horizontal plane according to an arrangement substantially parallel to the sole of the foot by following a slight rising inclination from the rear to the front. It is then necessary that the passage of the flexible link 11 take place by descending from the rear toward the front, so as not to increase successively the thickness of the sole 2 so that the thickness of the sole 2 will be comparable to the thickness of a shoe sole for walking or sport of known type.

This reversal of slope moreover ensures a natural anti-return blocking effect ensuring the blocking of the plates and of the axles in a predetermined position.

The front rollers 3*a*, 3*b* and rear rollers 4*a*, 4*b* are preferably removably mounted to permit their replacement in case of excessive wear. To permit this replacement, the axle 6 is removable from the support 7: this axle 6 can be constituted by a screw-threaded assembly or by an axle retained in place by elastic rings or the like.

Figure 3:
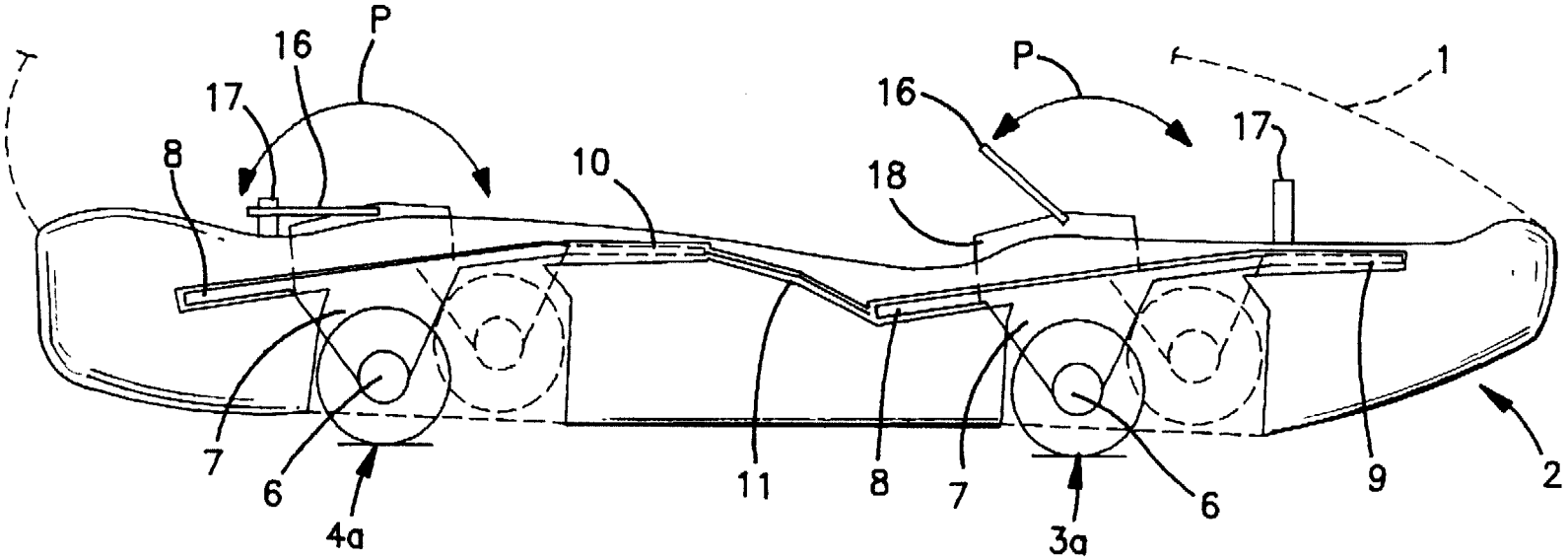
FIG. 3 shows schematically a cross-sectional view analogous to FIG. 1 of a second embodiment of the invention.
Figure 3:
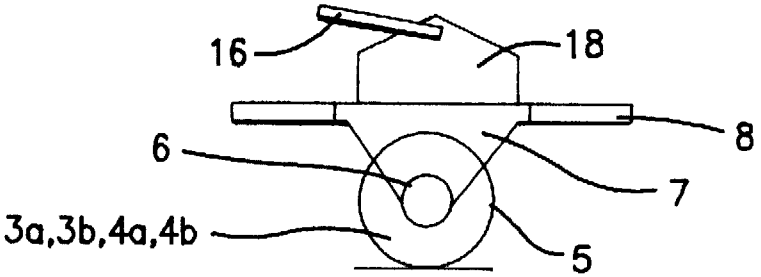

With reference to FIG. 3, the elements indicated by reference numerals identical to those in FIGS. 1 and 2 are identical or functional equivalents to the elements of FIGS. 1 and 2.

In this modified embodiment, the traction means do not comprise flexible links 12 and 13 described in reference to FIGS. 1 and 2; these traction means comprise rings 16 fixed on tongues bordering laterally the sole 2, adapted to coact with blocking means 17 of the hook type, reinforced rivet or the like to block the assembly of the support plates 8 and of the flexible link 11 in the position shown in full lines in contact with the ground or in the position shown in broken lines, raised and out of contact with the ground. The rings 16 are pivotally mounted on lateral tongues 18 so as to pivot about a horizontal axis in the direction of arrows P.

Thus, in this second embodiment of the invention, the gripping means 16 serve simultaneously as locking means for blocking the front rollers 3*a* and rear rollers 4*a* in one or the other of said positions of contact with the ground, or raised.

By comparison with the embodiment of FIGS. 1 and 2, in which the traction means 12 through 14 passing through the interior of the sole 2 and emerging at one or the other front or rear end of the sole, in this embodiment of FIG. 3 the gripping means pass through the interior of the sole 2 and emerge laterally on one or the other side of the sole 2.

Figure 4:
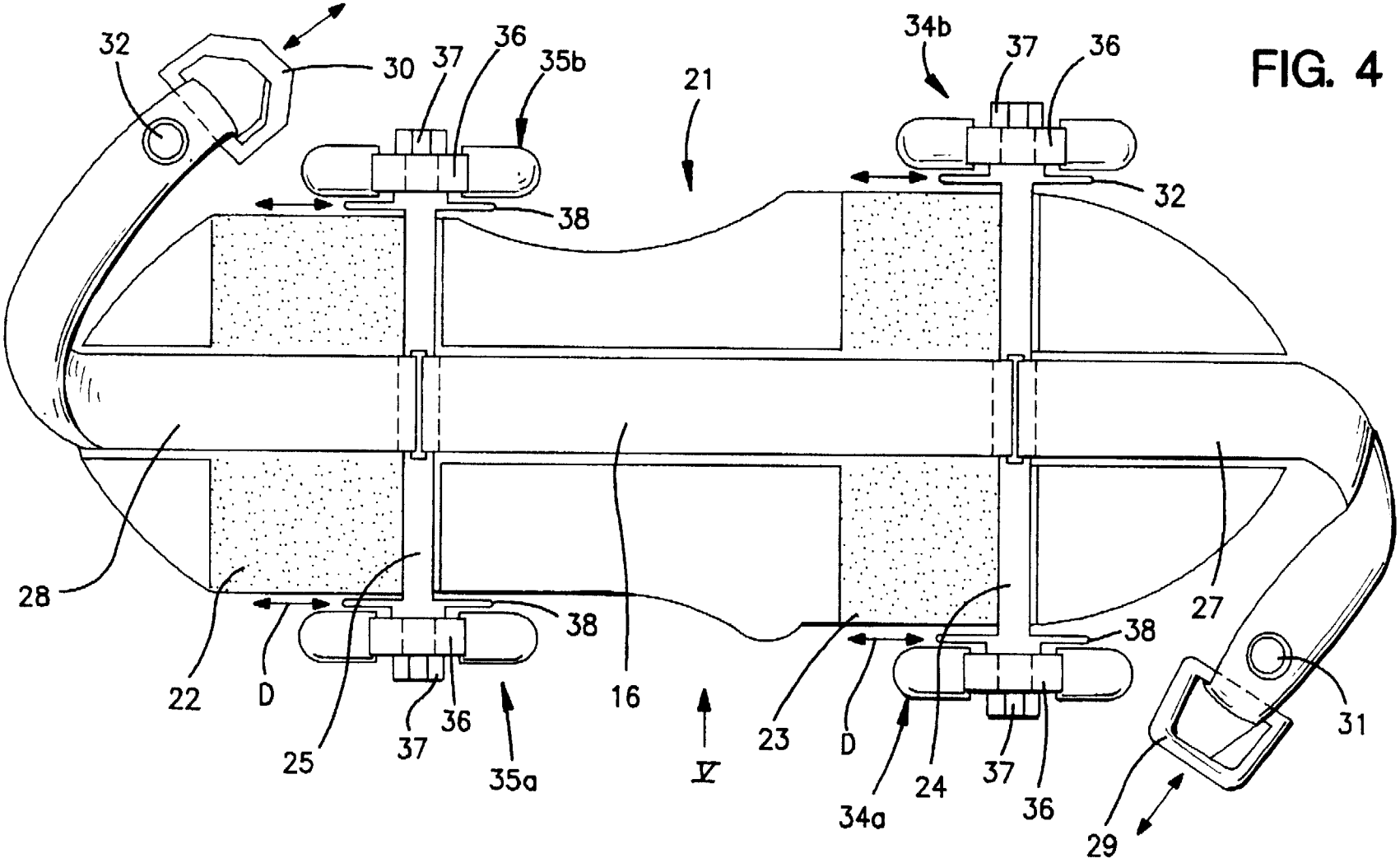
FIG. 4 shows schematically a cross-sectional view on the line IV—IV of FIG. 5 of a third embodiment of the invention.
Figure 5:
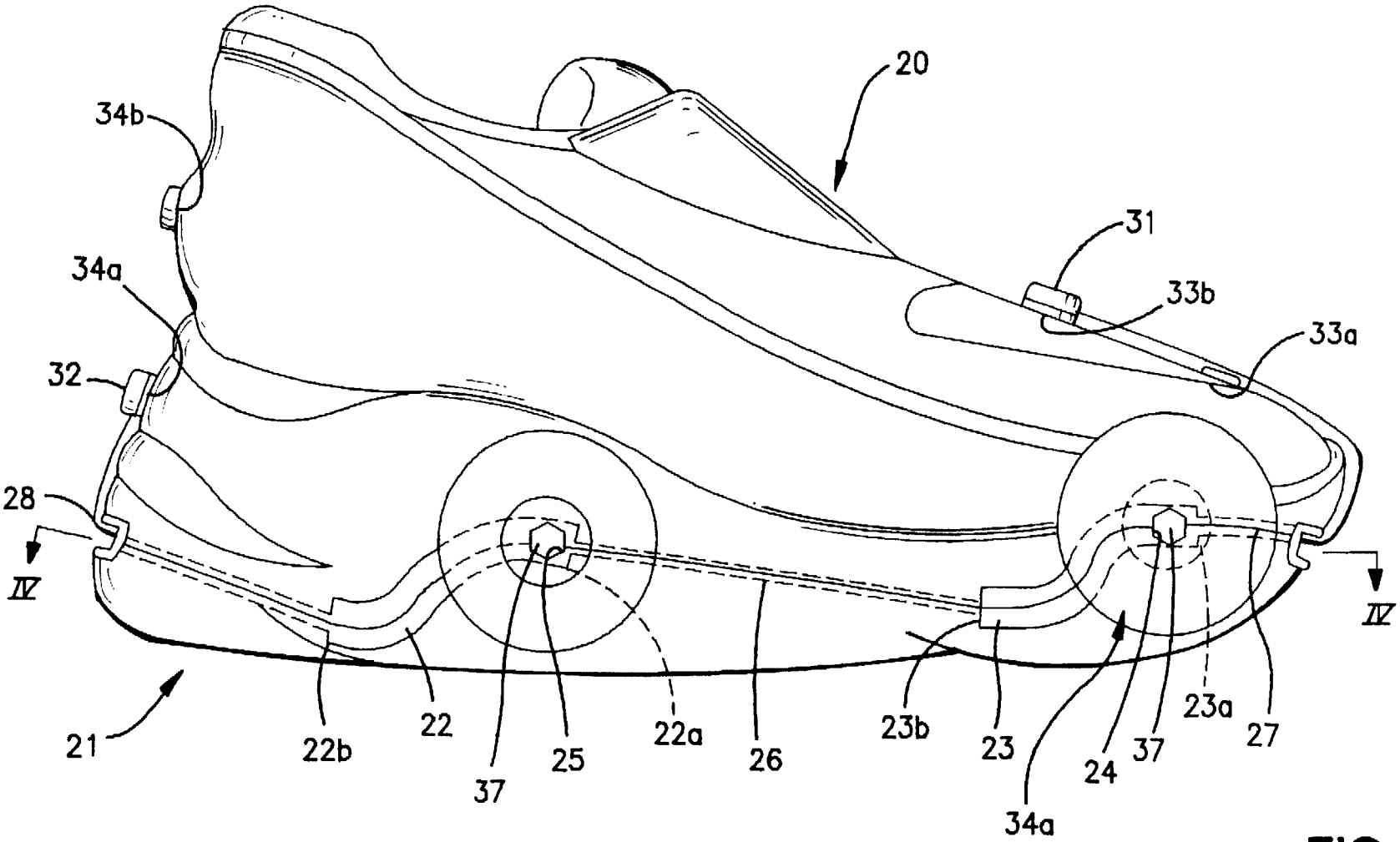
FIG. 5 shows schematically an elevational view in the direction of the arrow V of FIG. 4 of the third embodiment of the invention.

With reference to FIGS. 4 and 5, another embodiment according to the invention comprises an upper portion 20 adapted to receive the foot of a user and a lower portion 21 forming a sole.

The sole 21 comprises two through recesses 22 and 23 in which are mounted captively a front axle 24 and a rear axle 25. The front and rear axles 24, 25 are interconnected by a flexible link 26 passing through the interior of the sole 21. A flexible link 27 passing through the interior of the sole 21 is connected to the front axle and a flexible link 28 passing through the interior of the sole 21 is connected to the rear axle. The front flexible link 27 and rear flexible link 28 form with the traction rings 29 and 30 traction means adapted to displace the axles between a first position of contact with the ground (not shown) and a second raised position shown in full lines.

The rings 29 and 30 are secured to the straps 27 and 28 by push buttons 31 and 32 adapted to coact with rivets of corresponding push buttons 33*a*, 33*b* coacting with the button 31 and 34*a*, 34*b* coacting with the button 32.

Thus, after having simultaneously displaced the front and rear hubs 24 and 25 with the help of traction means 27 through 30 connected by means of axles to the flexible link 26, the user locks the axles and the rollers carried by these axles in position with the help of blocking means such as the push buttons 31 and 32 coacting with the portions of push buttons 33*a*, 33*b*, 34*a*, 34*b*.

The through recesses 22 and 23, in which the axles 24 and 25 are held captive, constitute guide formations for the movement of the axles between a position of contact with the ground and a raised position. The front slideway 23 secured to the sole 21 has a ramp shape rising in the direction of the front with a first horizontal portion, an inclined portion changing in direction corresponding to a point of inflection, and a second horizontal portion; the corresponding movement of the axles is thus imposed by the slideways 22 and 23 to follow a path similar to the profile of a toboggan.

Because the rollers 34*a*, 34*b* mounted on the front axle 24 and 35*a*, 35*b* mounted on the rear axle 25 are outside the sole 21 and extend beyond opposite sides of the shoe with rollers according to the invention, the sole 21 can have a very low height sufficient only to lodge the front slideway 23; moreover, the diameter of the rollers 34*a*, 34*b*, 35*a*, 35*b* is independent of the thickness of the sole and can be selected arbitrarily to have a diameter substantially greater than the thickness of the sole 21, as shown in FIG. 5 as to the front portion of the sole 21.

In the particular embodiment of FIGS. 4 and 5, the sole 21 has a thickness comparable to the thicknesses of sport shoe soles of known type and has a high flexibility. This characteristic permits bending of the sole during walking thereby giving rise to ergonomic walking conditions that do not tire the user of the shoe according to the invention.

The slideways 22 or 23 are preferably constituted by a material resistant to abrasion and have a hardness greater than that of the material of the sole in contact with the ground. The front ends 22*a* and 23*a* of the slideways constitute abutments for the axles 25 and 24 in the raised position, whilst the rear ends 22*b* and 23*b* constitute abutments for the axles 25 and 24 in the lowered rolling position in contact with the ground.

According to a preferred manufacturing method, the rollers 34*a*, 34*b*, 35*a*, 35*b* are constituted by overmolding an elastic material or a polyurethane on ball roller bearings 36 or roller bearings of a type known per se retained on the axles by nuts 37. The overmolding of the rolling strip on mechanical roller bearings of known type thus ensures complete resistance to lateral shocks and prevents the loss of the rolling strip from the rollers 34*a*, 34*b*, 35*a*, 35*b*.

Preferably, the flexible links 26 through 28 are constituted of a single continuous strap, belt or strip on which is secured the axles 24 and 25 in parallelism to each other.

The abutment surfaces 22*a*, 22*b* and 23*a*, 23*b* are also parallel to each other and orthogonal to the longitudinal axis of the shoe, such that the axles displaceable in the direction of the arrows D of FIG. 4 remain continuously parallel to each other during their displacement. It is preferred that the external surface of the axles comprises discs 38 of large external diameter preventing any axial misalignment of the axles and thus ensuring maintenance of their respective parallelism.

The invention described with reference to a particular embodiment is in no way limited thereto but covers on the contrary all modifications of shape and any variations of embodiment in which the front and rear rollers of a roller skate or a sole adapted to a shoe are interconnected by at least one flexible link permitting the simultaneous displacement of the front and rear rollers.

I claim:

1. Shoe with rollers, comprising at least one front roller (3*a*, 3*b*; 34*a*, 34*b*) and at least one rear roller (4*a*, 4*b*; 35*a*, 35*b*); the front rollers (3*a*, 3*b*; 34*a*, 34*b*) and rear rollers (4*a*, 4*b*; 35*a*, 35*b*) being displaceable between a first position in contact with the ground and a second raised position, characterized in that the front rollers (3*a*, 3*b*; 34*a*, 34*b*) and rear rollers (4*a*, 4*b*; 35*a*, 35*b*) are interconnected by at least one flexible link (11, 26), so as to displace simultaneously the front rollers (3*a*, 3*b*; 34*a*, 34*b*) and rear rollers (4*a*, 4*b*; 35*a*, 35*b*) with the aid of traction means (12–14; 16, 17, 27–30) coacting with said flexible link (11, 26).

2. Shoe with rollers according to claim 1, characterized in that the traction means (12–14; 16, 17, 27–30) comprise at least one flexible strap (12, 13; 27, 28), of which one end extending beyond the shoe comprises a handle gripping means (14, 30).

3. Shoe with rollers according to claim 2, characterized in that said flexible strap (12, 13; 27, 28) forming a part of said traction means passes through an internal recess of the sole (2, 21).

4. Shoe with rollers according to claim 1, characterized in that the traction means (12–14; 16, 17, 27–30) comprise locking means for the front rollers (3*a*, 3*b*; 34*a*, 34*b*) and rear rollers (4*a*, 4*b*; 35*a*, 35*b*) in each of said first position in contact with the ground and second raised position.

5. Shoe with rollers according to claim 1, characterized in that the front rollers (3*a*, 3*b*; 34*a*, 34*b*) and rear rollers (4*a*, 4*b*; 35*a*, 35*b*) are connected to front and rear plates (8) adapted to slide along guideways secured to the sole (2).

6. Shoe with rollers according to claim 1, characterized in that each front roller (34*a*, 34*b*) is mounted fixedly to a front axle (24), each rear roller (35*a*, 35*b*) is mounted fixedly to a rear axle (25), and in that the axles (24, 25) are interconnected by at least one flexible link (26).

7. Shoe with rollers according to claim 1, characterized in that the traction means (12–14; 16, 17, 27–30) comprise at least one flexible strap (12, 13; 27, 28), of which one end extending beyond the shoe comprises a pull-knob gripping means (14, 30).

8. Shoe sole provided with front rollers (3*a*, 3*b*; 34*a*, 34*b*) and rear rollers (4*a*, 4*b*; 35*a*, 35*b*) displaceable between a position in contact with the ground and a raised position, characterized in that the sole (2, 21) comprises recesses adapted to lodge at least two flexible links, of which the first (11, 26) connects the front rollers (3*a*, 3*b*; 34*a*, 34*b*) and rear rollers (4*a*, 4*b*; 35*a*, 35*b*) and of which at least a second (12, 13; 27, 28) is adapted to be pulled to displace the front and rear rollers from one of said two positions to the other of said two positions.

9. Sole according to claim 8, characterized in that each said second flexible link (12, 13; 27, 28) adapted to be pulled extends outside the sole (2, 21) and comprises at its outer end a blocking means (14, 31, 32).

10. Sole according to claim 8, characterized in that the sole (2, 21) comprises configurations (9, 10; 22, 23) constituting guide means for the movement of the front rollers (3*a*, 3*b*; 34*a*, 34*b*) and rear rollers (4*a*, 4*b*; 35*a*, 35*b*).

11. Sole according to claim 10, characterized in that said configurations comprise a front slideway (9, 23) secured to the sole (2, 21) and a rear slideway (10, 22) secured to the sole (2, 21).

12. Sole according to claim 9, characterized in that the sole (2, 21) comprises configurations (9, 10; 22, 23) constituting guide means for the movement of the front rollers (3*a*, 3*b*; 34*a*, 34*b*) and rear rollers (4*a*, 4*b*; 35*a*, 35*b*).

* * * * *